US008028539B2

(12) United States Patent
Yoon et al.

(10) Patent No.: US 8,028,539 B2
(45) Date of Patent: Oct. 4, 2011

(54) AIR CONDITIONER

(75) Inventors: Pil Hyun Yoon, Seoul (KR); Sai Kee Oh, Gyeonggi-do (KR); Jeong Seob Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 633 days.

(21) Appl. No.: 12/164,329

(22) Filed: Jun. 30, 2008

(65) Prior Publication Data

US 2009/0107173 A1 Apr. 30, 2009

(30) Foreign Application Priority Data

Oct. 25, 2007 (KR) ..... 10-2007-0107558

(51) Int. Cl.
*F25B 43/00* (2006.01)

(52) U.S. Cl. ..... 62/503; 62/510

(58) Field of Classification Search ..... 62/510, 62/157, 508, 503
See application file for complete search history.

(56) References Cited

U.S. PATENT DOCUMENTS

| | | | | | |
|---|---|---|---|---|---|
| 4,876,859 | A | * | 10/1989 | Kitamoto | 62/117 |
| 4,962,647 | A | * | 10/1990 | Kuwahara | 62/156 |
| 5,046,325 | A | * | 9/1991 | Kuwahara | 62/156 |
| 5,050,397 | A | * | 9/1991 | Sugiyama et al. | 62/175 |
| 5,170,636 | A | * | 12/1992 | Hitosugi | 62/175 |
| 5,673,570 | A | * | 10/1997 | Sada | 62/468 |
| 7,222,491 | B2 | * | 5/2007 | Moriwaki | 62/84 |
| 7,237,405 | B2 | * | 7/2007 | Takegami et al. | 62/498 |
| 7,257,964 | B2 | * | 8/2007 | Song et al. | 62/510 |
| 2007/0044490 | A1 | | 3/2007 | Lee | |
| 2007/0095084 | A1 | | 5/2007 | Park et al. | |
| 2007/0113568 | A1 | | 5/2007 | Jang et al. | |
| 2007/0130967 | A1 | | 6/2007 | Park et al. | |
| 2008/0028773 | A1 | | 2/2008 | Lee et al. | |

FOREIGN PATENT DOCUMENTS

| | | | |
|---|---|---|---|
| EP | 1367259 | | 12/2003 |
| EP | 1677057 | | 7/2006 |
| KR | 10-2003-0075194 | A | 9/2003 |
| KR | 10-2004-0099722 | A | 12/2004 |
| KR | 10-2006-0074790 | A | 7/2006 |

OTHER PUBLICATIONS

English language Abstract of KR 10-2003-0075194 A.
English language Abstract of KR 10-2006-0074790 A.
English language Abstract of KR 10-2004-0099722 A.

* cited by examiner

*Primary Examiner* — Mohammad Ali
(74) *Attorney, Agent, or Firm* — McKenna Long & Aldridge LLP

(57) ABSTRACT

Disclosed is an air conditioner which includes a plurality of compressors, a common inlet pipe through which fluid flows to the compressors, a plurality of inlet pipes branching off from the common inlet pipe which are connected to the compressors, a plurality of outlet pipes connected to the compressors through which refrigerant discharged from the compressors passes, and a plurality of bypass pipes connected to the compressors through which fluid discharged from the compressors passes. The fluid which passes through the plurality of bypass pipes is distributed to the plurality of compressors through the common inlet pipe.

24 Claims, 10 Drawing Sheets

AIR CONDITIONER

This application claims the benefit of Korean Application No. 10-2007-0107558, filed on Oct. 25, 2007, which is hereby incorporated by reference in its entirety.

BACKGROUND OF THE INVENTION

1. Field of the Invention

The present invention relates to an air conditioning system.

2. Description of the Related Art

An air conditioner is a device for controlling the temperature or humidity of air using a cycle of compression, condensation, expansion, and evaporation.

In some air conditioners, a plurality of indoor units are connected to one or more outdoor units. In this case, the number of compressors included in the outdoor units may vary according to the capacity of the indoor units. That is, a plurality of compressors can be included in one outdoor unit.

Oil collectors can be coupled to outlets of the compressors. The oil collectors collect oil and supply the collected oil to the inlets of the compressors through oil collection pipes.

Conventionally, the oil collected from one compressor is supplied back to the same compressor, and is not supplied to other compressors. Thus, the oil level of the compressors can be unbalanced. As a result, components of a compressor having insufficient oil can suffer from mechanical abrasion.

SUMMARY OF THE INVENTION

One of the advantages of the present invention is that it balances the oil levels of a plurality of compressors, so as to provide a sufficient amount of oil to each compressor, and to minimize damage to the compressors resulting from an insufficient oil amount.

To achieve this advantage, there is provided an air conditioner which includes a plurality of compressors, a common inlet pipe through which fluid flows to the compressors, a plurality of inlet pipes branching off from the common inlet pipe which are connected to the compressors, a plurality of outlet pipes connected to the compressors through which refrigerant discharged from the compressors passes, and a plurality of bypass pipes connected to the compressors through which fluid discharged from the compressors passes. The fluid which passes through the plurality of bypass pipes is distributed to the plurality of compressors through the common inlet pipe.

The air conditioner may also include a common bypass pipe which is connected to the common inlet pipe, and the fluid which passes through the plurality of bypass pipes may flow into the common bypass pipe. The plurality of bypass pipes may be connected to the common inlet pipe. The air conditioner may also include an accumulator which receives refrigerant from an evaporator, and separates gas and liquid portions of the received refrigerant, and the fluid which passes through the bypass pipes may move to the common inlet pipe through the accumulator.

At least one of the bypass pipes may include a pressure reducing part which reduces a pressure of fluid flowing in the respective bypass pipe. At least one of the pressure reducing parts may include a valve which changes a flow passage area of a respective bypass pipe. At least one of the pressure reducing parts may include a capillary.

The air conditioner may also include at least one bypass valve that opens and closes at least one of the bypass pipes. At least one of the bypass pipes may include a temperature sensor that measures a temperature of fluid in the respective bypass pipe. The air conditioner may also include a memory unit that stores a plurality of reference temperatures. The air conditioner may also include a control unit that compares the temperature measured by the temperature sensor with the plurality of reference temperatures, and controls the bypass valve based on the comparisons. The plurality of reference temperatures may correspond to a temperature of outdoor air.

There is also provided an air conditioner which includes a plurality of compressors, a common inlet pipe through which fluid flows to the compressors, a plurality of inlet pipes branching off from the common inlet pipe which are connected to the compressors, a bypass unit that guides fluid discharged from the compressors to the common inlet pipe, and a pressure reducing part that reduces a pressure of fluid flowing in the bypass unit.

The bypass unit may include a plurality of bypass pipes connected between the compressors and the common inlet pipe, and the bypass pipes may include pressure reducing parts. The bypass unit may include a plurality of bypass pipes connected to the compressors, and a common bypass pipe connected between the bypass pipes and the common inlet pipe, and the pressure reducing part may be disposed at the common bypass pipe or at each of the bypass pipes. The bypass unit may include a plurality of bypass pipes connected to the compressors, and a common bypass pipe connected between the bypass pipes and an accumulator.

The pressure reducing part may be a capillary. The air conditioner may include a bypass valve that selectively allows fluid to flow in the bypass unit, the bypass valve being periodically opened. The pressure reducing part may be a valve capable of adjusting a size of a flow passage, and the size of the flow passage may be periodically adjusted. The bypass unit may include a temperature sensor that measures a temperature of fluid passing through the pressure reducing part, and an amount of fluid flowing in the bypass unit may be adjusted based on the measured temperature.

There is also provided an air conditioner which includes a plurality of compressors, a plurality of bypass pipes connected to the compressors to form bypass passages that allow fluid in the compressors to be redistributed among the compressors, and a plurality of temperature sensors disposed at the bypass pipes that measure temperatures of fluid flowing in the bypass pipes. Amounts of fluid flowing in the bypass pipes are adjusted based on the measured temperatures.

The bypass pipes may include pressure reducing parts, and the temperature sensors may measure temperatures of fluid passing through the pressure reducing parts. When the measured temperatures correspond to a reference refrigerant temperature, streams of fluid to the bypass pipes may be interrupted. When the measured temperatures correspond to a reference oil temperature, streams of fluid to the bypass pipes may be allowed. When the measured temperatures correspond to a reference temperature, streams of fluid to the bypass pipes may be interrupted.

Additional advantages and features of the invention will be set forth in part in the description which follows and in part will become apparent to those having ordinary skill in the art upon examination of the following or may be learned from practice of the invention.

DETAILED DESCRIPTION OF THE INVENTION

Reference will now be made in detail to the preferred embodiments of the present invention, examples of which are illustrated in the accompanying drawings.

Figure 1:
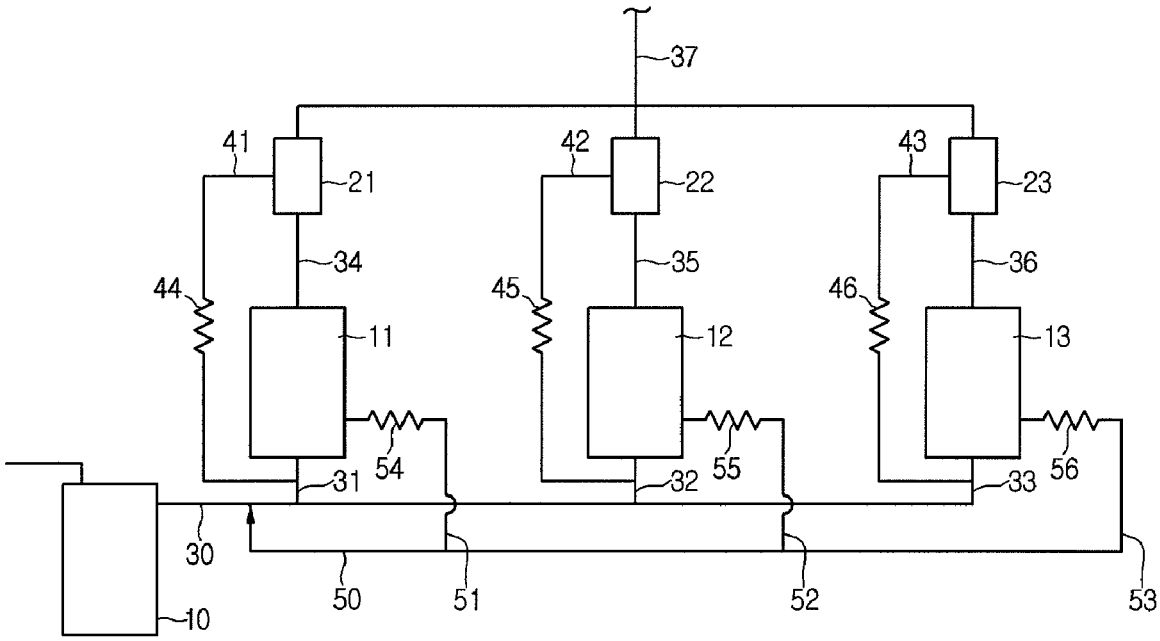
FIG. 1 is a diagram of an air conditioner according to a first embodiment of the invention.

FIG. 1 is a diagram of an air conditioner according to a first embodiment of the invention.

Referring to FIG. 1, the air conditioner of the first embodiment includes a plurality of compressors such as first, second, and third compressors 11, 12, and 13 that are disposed in parallel. Although three compressors are provided in the first embodiment shown in FIG. 1, the number of compressors can vary.

The capacities of the compressors 11, 12, and 13 can be different. Furthermore, various types of compressors can be used as the compressors 11, 12, and 13. For example, an inverter compressor having a variable rotation speed or a constant speed compressor can be used.

An inlet pipe unit is connected to the compressors 11, 12, and 13 to supply a refrigerant from an evaporator (not shown) to the compressors 11, 12, and 13. The inlet pipe unit includes a common inlet pipe 30 and a plurality of inlet pipes 31, 32, and 33. The common inlet pipe 30 receives a refrigerant discharged from the evaporator, and the inlet pipes 31, 32, and 33 branch off from the common inlet pipe 30 and are connected to the compressors 11, 12, and 13, respectively.

A refrigerant introduced into the common inlet pipe 30 is distributed to the inlet pipes 31, 32, and 33 and then supplied to the compressors 11, 12, and 13. The common inlet pipe 30 is connected to an accumulator 10. The accumulator 10 separates gas and liquid portions of a refrigerant discharged from the evaporator.

Only the gaseous refrigerant is supplied to the common inlet pipe 30 from the accumulator 10, and the liquid refrigerant is stored in the accumulator 10.

The air conditioner may include a plurality of outdoor units, and the accumulator 10 may be external to the plurality of outdoor units, and connected to all of the compressors of the plurality of outdoors units. Alternatively, the accumulator 10 may be internal to one of the plurality of outdoor units, yet still be shared by all of the compressors of the plurality of outdoors units.

An outlet pipe unit is connected to the compressors 11, 12, and 13 for carrying a refrigerant discharged from the compressors 11, 12, and 13. The outlet pipe unit includes a plurality of outlet pipes 34, 35, and 36, and a common outlet pipe 37. The outlet pipes 34, 35, and 36 are connected to the compressors 11, 12, and 13, respectively. The common outlet pipe 37 is commonly connected to the outlet pipes 34, 35, and 36 for combining streams of a refrigerant from the compressors 11, 12, and 13.

A refrigerant discharged from the compressors 11, 12, and 13 flows along the outlet pipes 34, 35, and 36, and then the streams of the refrigerant gather at the common outlet pipe 37. Thereafter, the refrigerant moves to a condenser (not shown).

Oil collectors 21, 22, and 23 are disposed at the outlet pipes 34, 35, and 36 to collect oil from a refrigerant discharged from the compressors 11, 12, and 13.

Oil collector pipes 41, 42, and 43 are connected to the oil collectors 21, 22, and 23 to supply the oil collected by the oil collectors 21, 22, and 23 back to inlets of the compressors 11, 12, and 13.

That is, oil collected by the oil collectors 21, 22, and 23 is supplied back to the inlet pipes 31, 32, and 33 through the oil collector pipes 41, 42, and 43.

Capillaries 44, 45, and 46 are disposed at the oil collector pipes 41, 42, and 43, respectively, for pressure reduction. The capillaries 44, 45, and 46 reduce the pressure of oil discharged from the compressors 11, 12, and 13 for supplying the oil back to the inlet pipes 31, 32, and 33.

A bypass unit is connected to the compressors 11, 12, and 13 for discharging oil from the compressors 11, 12, and 13 when the compressors 11, 12, and 13 contain excessive oil.

The bypass unit includes a common bypass pipe 50 and a plurality of bypass pipes, such as first, second, and third bypass pipes 51, 52, and 53. The bypass pipes 51, 52, and 53 are connected to the compressors 11, 12, and 13, respectively. The common pipe 50 is commonly connected to the bypass pipes 51, 52, and 53 for combining oil streams of the bypass pipes 51, 52, and 53. The common pipe 50 is also connected to the common inlet pipe 30.

The bypass pipes 51, 52, and 53 are connected to the compressors 11, 12, and 13 at heights higher than normal oil levels in the compressors 11, 12, and 13.

The normal oil levels of the compressors 11, 12, and 13 vary according to the capacities of the compressors 11, 12, and 13. Therefore, the bypass pipes 51, 52, and 53 can be connected to the compressors 11, 12, and 13 at different heights.

Pressure reducing parts 54, 55, and 56 are disposed at the bypass pipes 51, 52, and 53, respectively. The pressure reducing parts 54, 55, and 56 are used to reduce the pressure of a fluid discharged from the compressors 11, 12, and 13. Capillaries can be used as the pressure reducing parts 54, 55, and 56.

The compressors 11, 12, and 13 may be high-pressure compressors. In this case, oil is stored in the compressors 11, 12, and 13 at a high pressure. Thus, a fluid can be discharged from the compressors 11, 12, and 13 to the bypass pipes 51, 52, and 53 due to the high pressure of the oil in the compressors 11, 12, and 13.

While flowing in the bypass pipes 51, 52, and 53, the fluid is expanded by the pressure reducing parts 54, 55, and 56, and thus the temperature and pressure of the fluid decreases.

The fluid may include a refrigerant and/or oil. When the compressors 11, 12, and 13 contain excessive oil, oil may be discharged from the compressors 11, 12, and 13 to the bypass pipes 51, 52, and 53. On the other hand, when the amount of oil contained in the compressors 11, 12, and 13 is proper or insufficient, a refrigerant may be discharged from the compressors 11, 12, and 13 to the bypass pipes 51, 52, and 53.

A refrigerant discharged from the compressors 11, 12, and 13 to the bypass pipes 51, 52, and 53 is supplied back to the inlets of the compressors 11, 12, and 13. A low-pressure refrigerant should be supplied to the inlets of the compressors 11, 12, and 13. However, the pressure of the refrigerant flowing in the bypass pipes 51, 52, and 53 is high. Therefore, in the current embodiment, the pressure reducing parts 54, 55, and 56 are disposed in the bypass pipes 51, 52, and 53 to decrease the pressure of the refrigerant.

An operation of the air conditioner will now be described.

Figure 2:
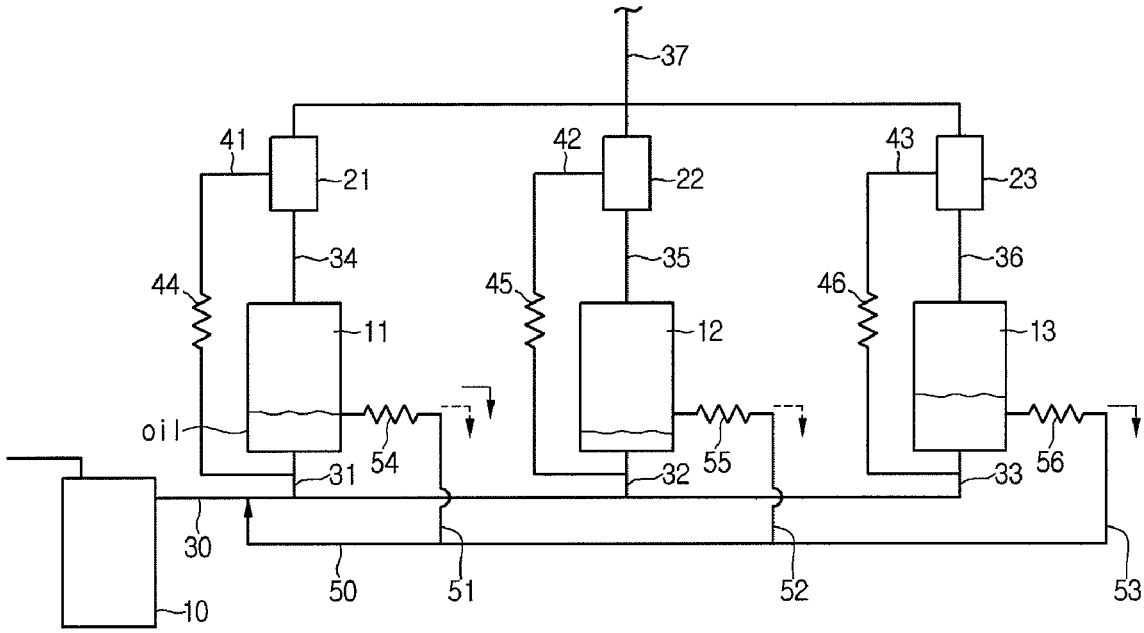
FIG. 2 is a diagram for illustrating an operation of the air conditioner depicted in FIG. 1.

FIG. 2 is a diagram which illustrates an operation of the air conditioner depicted in FIG. 1.

Referring to FIG. 2, when the air conditioner begins operation, the compressors 11, 12, and 13 operate. Then, a refrigerant is introduced into the compressors 11, 12, and 13 and compressed. Thereafter, the compressed refrigerant is discharged to the outlet pipes 34, 35, and 36 together with oil.

The refrigerant and oil flow along the outlet pipes 34, 35, and 36 and enter the oil collectors 21, 22, and 23. The oil collectors 21, 22, and 23 separate the refrigerant and the oil.

The separated refrigerant is discharged to the common outlet pipe 37 from the oil collectors 21, 22, and 23. Then, the refrigerant flows to the accumulator 10 after sequentially passing through a condenser (not shown), an expansion unit (not shown), and an evaporator (not shown).

The separated oil is discharged to the oil collector pipes 41, 42, and 43 from the oil collectors 21, 22, and 23. Then, the oil flows along the oil collector pipes 41, 42, and 43 to the inlet pipes 31, 32, and 33.

Meanwhile, while the compressors 11, 12, and 13 operate, a refrigerant and oil are discharged from the compressors 11, 12, and 13 to the bypass pipes 51, 52, and 53.

As shown in FIG. 2, the oil level of the first compressor 11 approximately corresponds to the height at which the first bypass pipe 51 is connected to the compressor 11. Thus, some of a refrigerant compressed in the first compressor 11 is discharged to the first bypass pipe 51 together with some oil.

The oil level of the second compressor 12 is lower than the height at which the second bypass pipe 52 is connected to the compressor 12. Thus, although some of a refrigerant compressed in the second compressor 12 is discharged to the second bypass pipe 52 (indicated by a dashed line), oil is not discharged from the second compressor 12 to the second bypass pipe 52. Meanwhile, the rest of the refrigerant compressed in the second compressor 12 is discharged to the outlet pipe 35.

The oil level of the third compressor 13 is higher than the height at which the third bypass pipe 53 is connected to the compressor 13. Thus, although some oil is discharged to the third bypass pipe 53 (indicated by a solid line), a refrigerant is not discharged from the third compressor 13 to the third bypass pipe 53.

The refrigerant and the oil discharged to the bypass pipes 51, 52, and 53 are reduced in pressure by the pressure reducing parts 54, 55, and 56, and then are guided to the common pipe 50. The refrigerant and the oil are moved from the common pipe 50 to the common inlet pipe 30 and are distributed to the inlet pipes 31, 32, and 33. Therefore, surplus oil discharged from one of the compressors 11, 12, and 13 can be distributed to all the compressors 11, 12, and 13.

According to the current embodiment, when oil is excessively contained in one of the compressors 11, 12, and 13, the excess oil can be discharged from the compressor through the bypass pipe connected to the compressor, and then the discharged oil can be distributed to all the compressors 11, 12, and 13. Therefore, a compressor containing insufficient oil can be supplied with oil from the other compressors, and thus damages caused by insufficient oil can be prevented.

Furthermore, since surplus oil can be uniformly distributed to all the compressors 11, 12, and 13, the oil levels of the compressors 11, 12, and 13 can be balanced.

Figure 3:
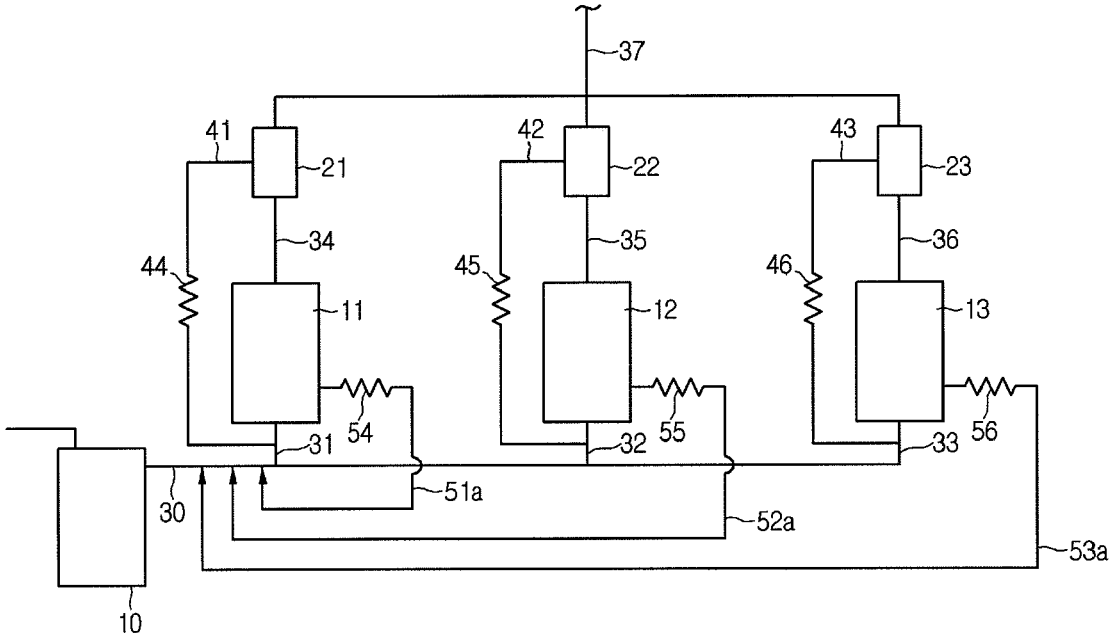
FIG. 3 is a diagram of an air conditioner according to a second embodiment of the invention.

FIG. 3 is a diagram of an air conditioner according to a second embodiment of the invention.

The air conditioner of the second embodiment has the same structure as the air conditioner of the first embodiment except for the structure of a bypass unit. In the following description of the second embodiment, only the differences between the embodiments are explained.

Referring to FIG. 3, bypass pipes 51*a*, 52*a*, and 53*a* are connected from compressors 11, 12, and 13 to a common inlet pipe 30.

Therefore, fluid is guided from the bypass pipes 51*a*, 52*a*, and 53*a* directly to the common inlet pipe 30, and then are combined at the common inlet pipe 30. Therefore, according to the current embodiment, an additional common pipe such as the common pipe 50 shown in FIG. 1 is not necessary to combine refrigerant or oil flowing in the bypass pipes 51*a*, 52*a*, and 53*a*.

Figure 4:
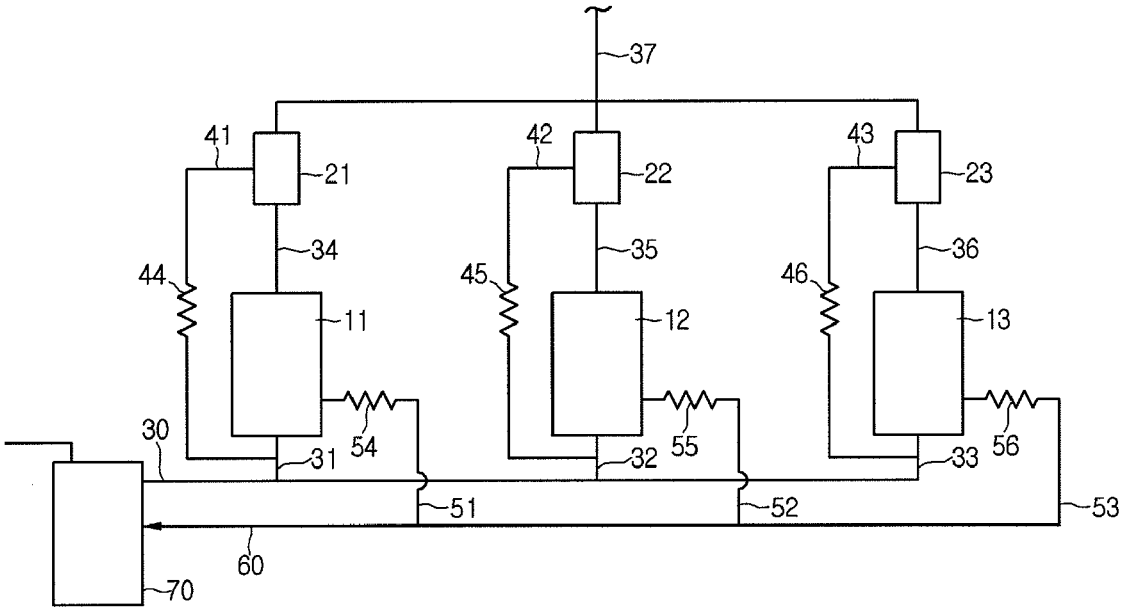
FIG. 4 is a diagram of an air conditioner according to a third embodiment of the invention.
Figure 5:
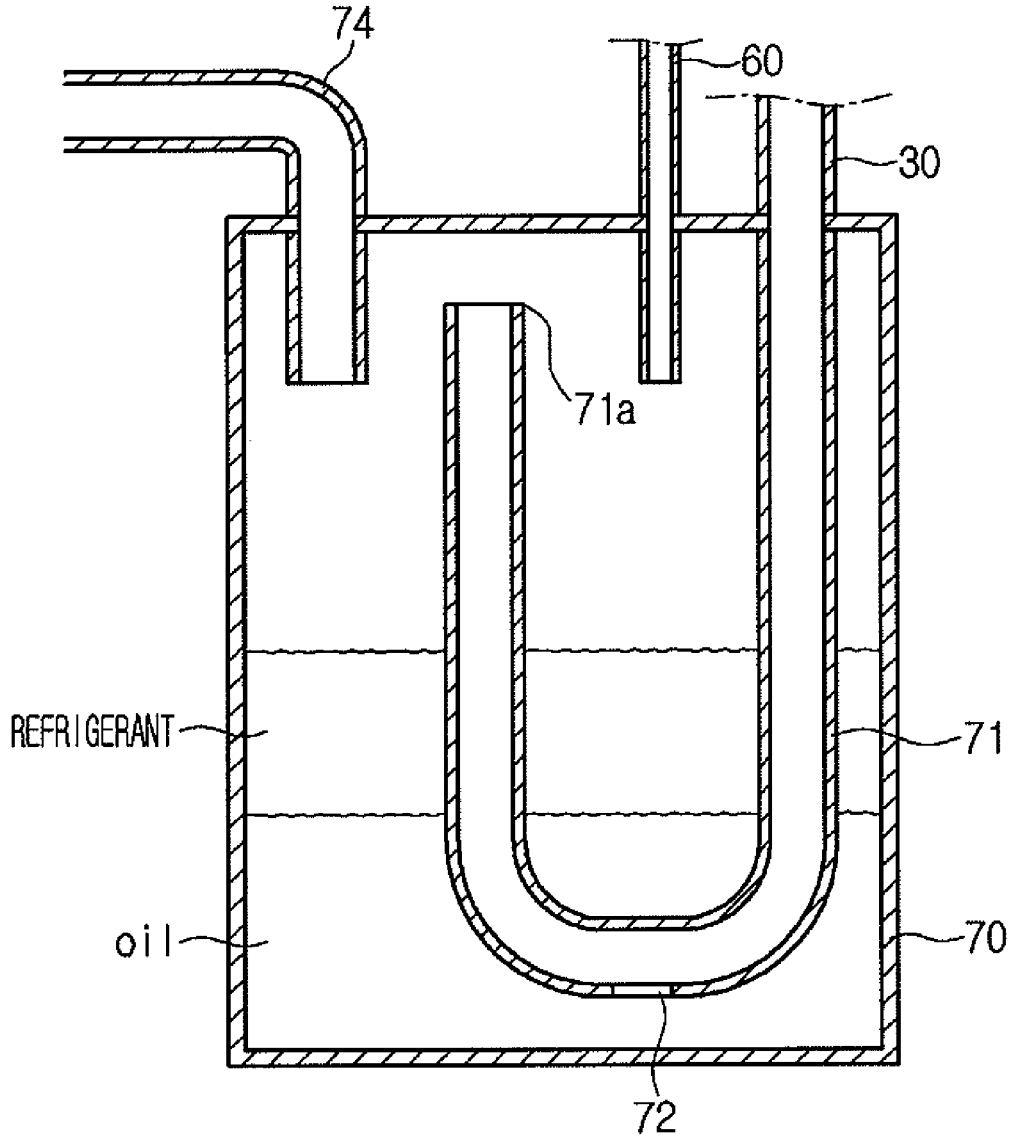
FIG. 5 is a sectional diagram of an accumulator of the air conditioner depicted in FIG. 4.

FIG. 4 is a diagram of an air conditioner according to a third embodiment of the invention, and FIG. 5 is a sectional diagram of an accumulator of the air conditioner depicted in FIG. 4.

The air conditioner of the third embodiment has the same structure as the air conditioner of the first embodiment except for the structure of a common bypass pipe. In the following description of the third embodiment, only the differences between the embodiments are explained.

Referring to FIGS. 4 and 5, ends of bypass pipes 51, 52, and 53 are connected to compressors 11, 12, and 13. Opposite ends of the bypass pipes 51, 52, and 53 are connected to a common bypass pipe 60 such that fluid from the bypass pipes 51, 52, and 53 can be combined at the common pipe 60. The common pipe 60 is connected to an accumulator 70.

Oil in the accumulator 70 is transferred to a common inlet pipe 30. The accumulator 70 stores oil that is discharged from an evaporator, as well as oil which is received from the common pipe 60. In this regard, oil which is not collected by oil collectors 21, 22, and 23 passes through a condenser, an expansion unit, and the evaporator together with refrigerant, and then is guided to the accumulator 70.

The accumulator 70 separates gas and liquid portions of a refrigerant and allows only the gas refrigerant to flow to the compressors 11, 12, and 13. FIG. 5 illustrates an exemplary embodiment of the accumulator 70. In this embodiment, a U-shaped gas refrigerant pipe 71 is disposed in the accumulator 70. One end of the gas refrigerant pipe 71 is connected to the common inlet pipe 30. A connection pipe 74 is connected to the accumulator 70 to supply a refrigerant discharged from the evaporator to the accumulator 70.

When a refrigerant is introduced into the accumulator 70, a gas portion of the refrigerant can flow to the gas refrigerant pipe 71 through an inlet 71*a* of the gas refrigerant pipe 71. The remaining liquid portion of the refrigerant is stored at a lower portion of the accumulator 70.

An oil hole 72 is formed in a lower portion of the gas refrigerant pipe 71 to allow oil stored in the accumulator 70 to flow into the gas refrigerant pipe 71. In the accumulator 70, the liquid refrigerant lies on top of the oil, since the liquid refrigerant is lighter than the oil.

The temperature of the oil introduced into the accumulator 70 from the common pipe 60 is higher than that of the liquid refrigerant and the oil stored in the accumulator 70. Thus, the oil discharged from the common pipe 60 is cooled by the oil previously stored in the accumulator 70.

Therefore, high-temperature oil collected from the compressors 11, 12, and 13 can be first cooled by pressure reducing parts 54, 55, and 56 and secondly cooled in the accumulator 70. This prevents the gas refrigerant from being heated by the oil in the accumulator 70, and thus allows a low-temperature gas refrigerant to be supplied to the compressors 11, 12, and 13 from the accumulator 70.

In the current embodiment, the oil hole 72 is formed in the gas refrigerant pipe 71 to allow oil to flow from the accumulator 70 to the compressors 11, 12, and 13 through the gas refrigerant pipe 71. However, as an alternative to the oil hole 72, an oil pipe can be connected from a lower portion of the accumulator 70 to the common inlet pipe 30 to allow oil to flow from the accumulator 70 to the compressors 11, 12, and 13 through the oil pipe and the common inlet pipe 30. In this case, a valve can be disposed at the oil pipe to control the flow rate of the oil.

In the current embodiment, the common pipe 60 is connected to the accumulator 70. However, the common pipe 60 can be connected directly to the connection pipe 74, through which refrigerant is discharged from the evaporator.

Figure 6:
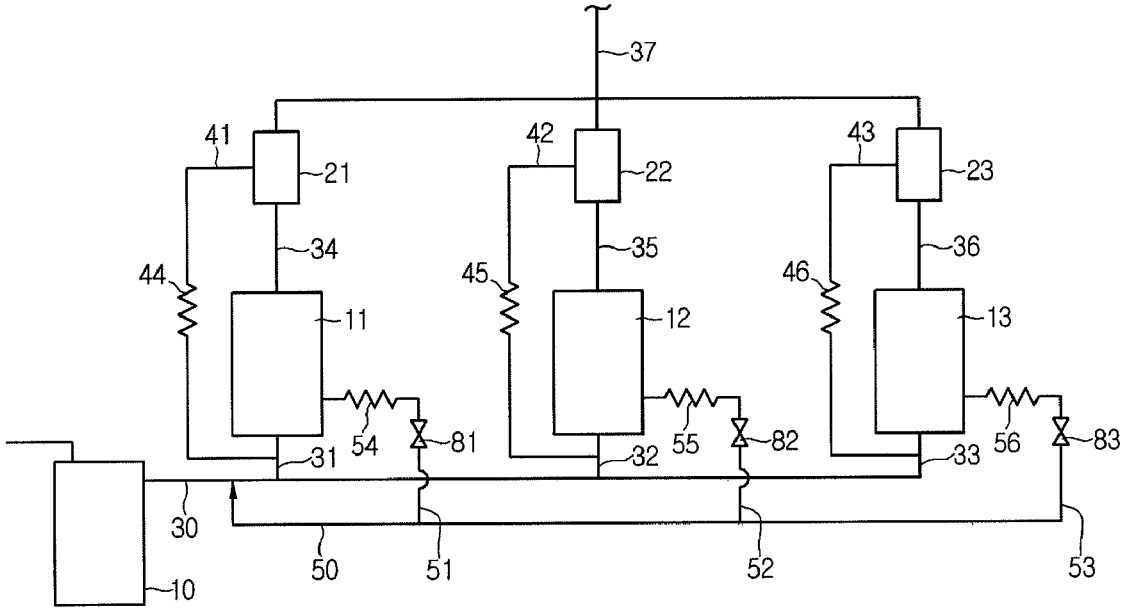
FIG. 6 is a diagram of an air conditioner according to a fourth embodiment of the invention.

FIG. 6 is a diagram of an air conditioner according to a fourth embodiment of the invention.

The air conditioner of the fourth embodiment has the same structure as the air conditioner of the first embodiment except for bypass valves disposed at the bypass pipes. In the following description of the fourth embodiment, only the differences between the embodiments are explained.

Referring to FIG. 6, bypass valves 81, 82, and 83 are disposed at bypass pipes 51, 52, and 53 to selectively open and close the bypass pipes 51, 52, and 53.

The bypass valves 81, 82, and 83 are periodically opened to allow a refrigerant or oil to flow from compressors 11, 12, and 13 to the bypass pipes 51, 52, and 53.

According to the current embodiment, an unnecessary flow of a high-pressure refrigerant from the compressors 11, 12, and 13 to the bypass pipes 51, 52, and 53 can be prevented.

Figure 7:
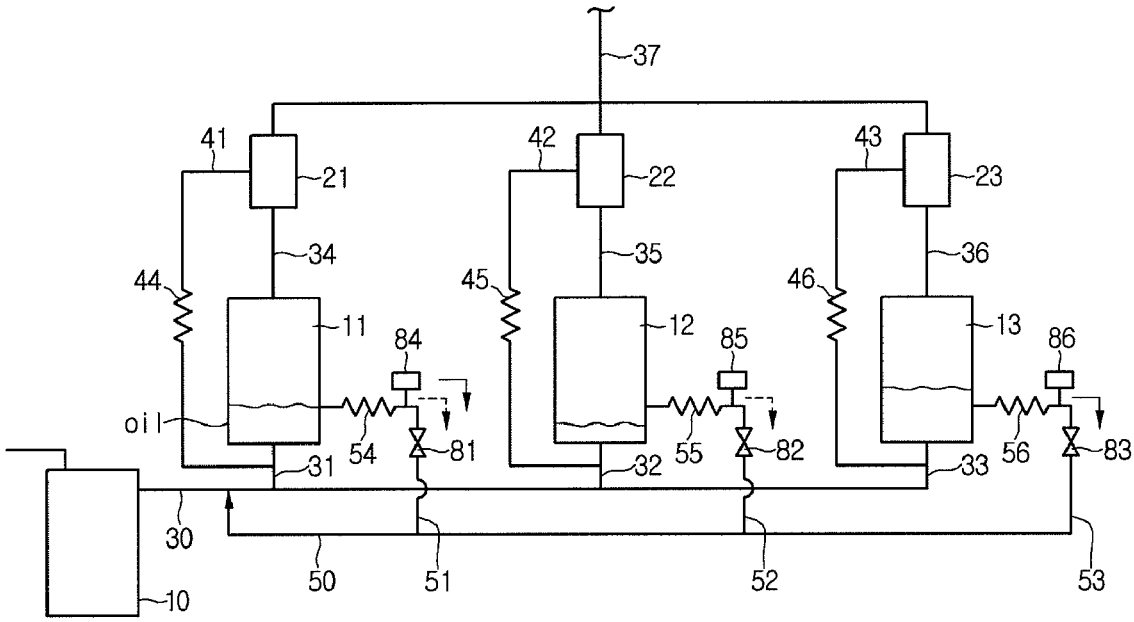
FIG. 7 is a diagram of an air conditioner according to a fifth embodiment of the invention.

FIG. 7 is a diagram of an air conditioner according to a fifth embodiment of the invention.

The air conditioner of the fifth embodiment has the same structure as the air conditioner of the fourth embodiment except for temperature sensors disposed at the bypass pipes. In the following description of the fifth embodiment, only the differences between the embodiments are described.

Referring to FIG. 7, pressure reducing parts 54, 55, and 56, first to third temperature sensors 84, 85, and 86, and first to third bypass valves 81, 82, and 83 are disposed at bypass pipes 51, 52, and 53, respectively. The pressure reducing parts 54, 55, and 56 reduce the pressure of a fluid discharged from compressors 11, 12, and 13. The temperature sensors 84, 85, and 86 are used to measure the temperature of the fluid after the fluid passes through the pressure reducing parts 54, 55, and 56. The bypass valves 81, 82, and 83 are used to selectively open and close the bypass pipes 51, 52, and 53.

A refrigerant or oil discharged from the compressors 11, 12, and 13 to the bypass pipes 51, 52, and 53 are guided to the pressure reducing parts 54, 55, and 56, where the refrigerant or the oil expands and reduces in temperature. After the refrigerant or the oil passes through the pressure reducing parts 54, 55, and 56, the temperature of the refrigerant or the oil can be measured using the temperature sensors 84, 85, and 86.

In the current embodiment, the temperature sensors 84, 85, and 86 are disposed outside the bypass pipes 51, 52, and 53. Thus, the temperature of the refrigerant or the oil can be indirectly measured by measuring the temperature of the bypass pipes 51, 52, and 53.

Meanwhile, since refrigerant and oil have different physical properties, temperature variations of the refrigerant and the oil differ as they pass through the pressure reducing parts 54, 55, and 56. The temperature variation of the refrigerant may be larger than that of the oil. That is, the temperature of the refrigerant may drop more than the temperature of the oil.

Since the temperature variations of the refrigerant and the oil are different, whether a refrigerant or oil passes through the bypass pipes 51, 52, and 53 can be determined using the temperatures measured by the temperature sensors 84, 85, and 86.

When the temperature of a fluid discharged from the compressors 11, 12, and 13 is high, the temperature of the fluid decreases largely as compared with the case where the temperature of a fluid discharged from the compressors 11, 12, and 13 is low. Therefore, the current embodiment may be advantageous when high-pressure compressors are used as the compressors 11, 12, and 13.

Figure 8:
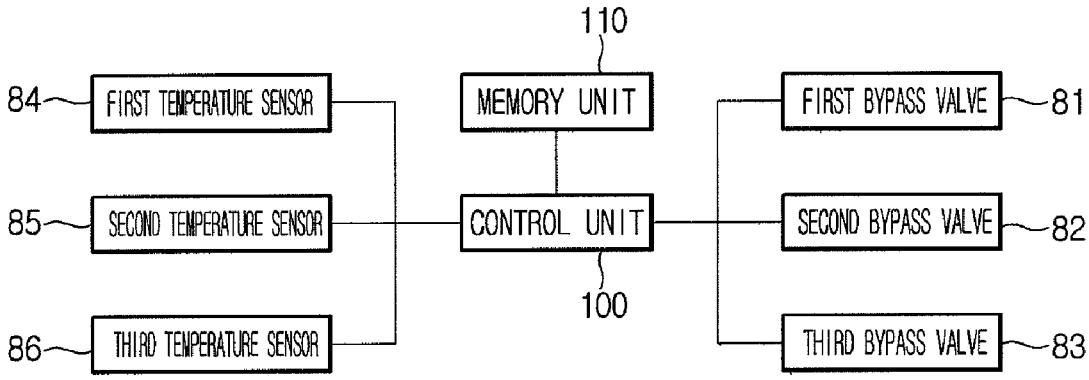
FIG. 8 is a control block diagram of the air conditioner depicted in FIG. 7.

FIG. 8 is a control block diagram of the air conditioner depicted in FIG. 7.

Referring to FIG. 8, the air conditioner of the current embodiment includes: the first to third temperature sensors 84, 85, and 86 disposed at the bypass pipes 51, 52, and 53; a memory unit 110 which stores reference temperatures for comparison with temperatures of a refrigerant or oil after the refrigerant or the oil passes through the pressure reducing parts 54, 55, and 56; a control unit 100 which compares temperatures of the refrigerant or oil measured by the temperature sensors 84, 85, and 86 with the reference temperatures stored in the memory unit 110; and the first to third bypass valves 81, 82, and 83, which selectively open and close the bypass pipes 51, 52, and 53 under the control of the control unit 100.

The control unit 100 controls the bypass valves 81, 82, and 83 to open and close, and thus controls the discharge of fluid from the compressors 11, 12, and 13 to the bypass pipes 51, 52, and 53.

The memory unit 110 stores a reference refrigerant temperature T1 and a reference oil temperature T2 corresponding to refrigerant and oil passing through the pressure reducing parts 54, 55, and 56. The memory unit 110 further stores a reference temperature T3 for determining whether a proper amount of oil is stored in the compressors 11, 12, and 13.

The reference temperature T3 may be between the reference refrigerant temperature T1 and the reference oil temperature T2. A temperature of a refrigerant measured by the temperature sensors 84, 85, and 86 is lower than a temperature of oil measured by the temperature sensors 84, 85, and 86; however, a mixture of refrigerant and oil may flow in the bypass pipes 51, 52, and 53 where the temperature sensors 84, 85, and 86 are disposed.

That is, the temperature of a fluid which includes a mixture of refrigerant and oil will be higher than a temperature of fluid which includes only refrigerant, and will be lower than a temperature of fluid which includes only oil.

Therefore, in the current embodiment, the reference temperature T3 is provided as a reference temperature for a fluid flowing in the bypass pipes 51, 52, and 53 which includes a mixture of refrigerant and oil.

The reference refrigerant temperature T1, the reference oil temperature T2, and the reference temperature T3 can be varied according to an outdoor air temperature. In this regard, since the temperature of refrigerant or oil flowing in the bypass pipes 51, 52 and 53 varies in proportion to the outdoor air temperature, the temperatures T1, T2, and T3 may be set to high values when the outdoor air temperature is high.

Thus, the temperatures T1, T2, and T3 stored in the memory unit 110 may vary in accordance with an outdoor air temperature.

The control unit 100 compares temperatures measured by the temperature sensors 84, 85, and 86 with the temperatures T1, T2, and T3 stored in the memory unit 110 so as to determine whether a refrigerant or oil flows in the bypass pipes 51, 52, and 53, and controls the bypass valves 81, 82, and 83 accordingly.

Figure 9:
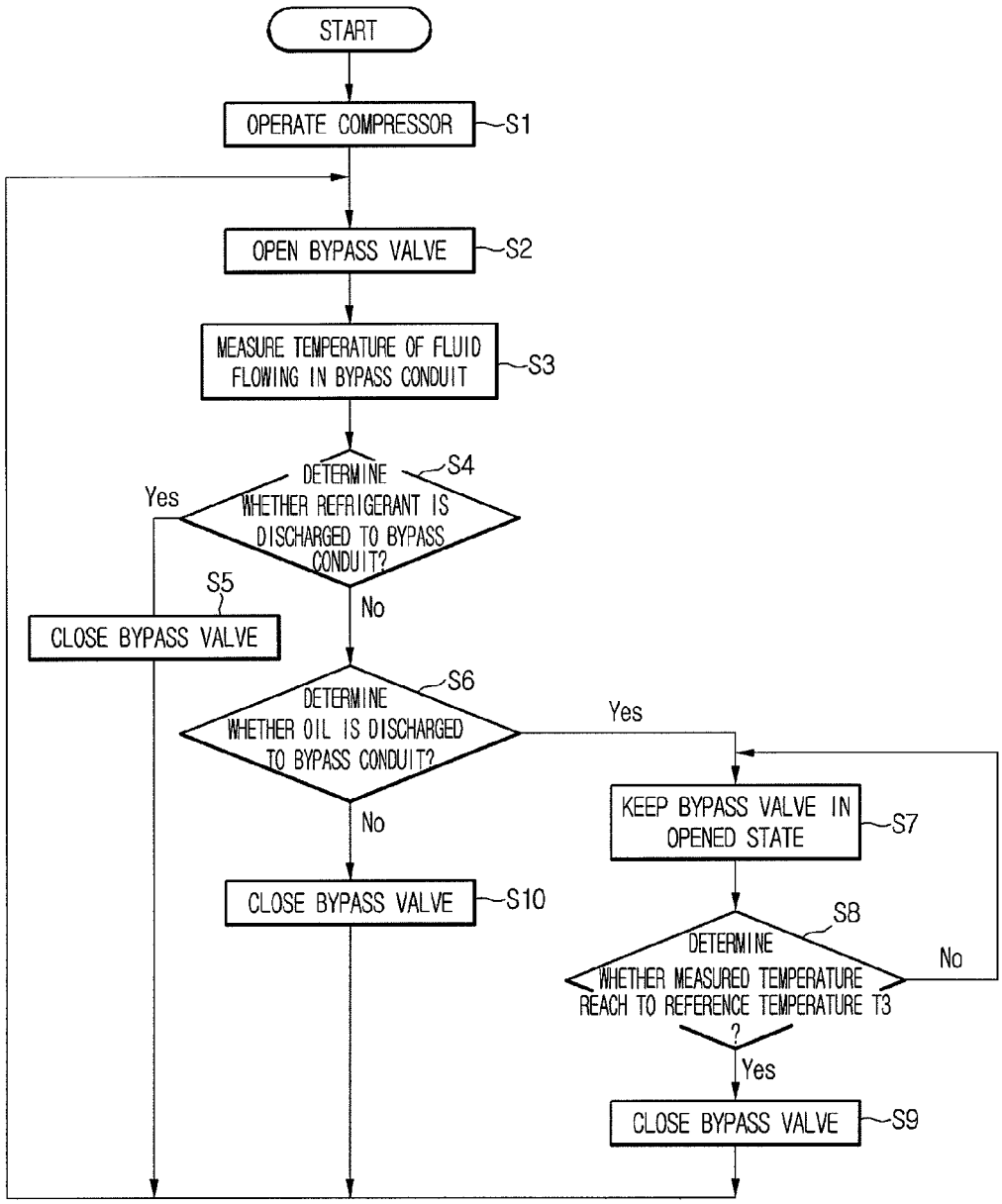
FIG. 9 is a flowchart for explaining a method of controlling the air conditioner depicted in FIG. 7.

FIG. 9 is a flowchart for explaining a method of controlling the air conditioner depicted in FIG. 7.

The method of controlling the air conditioner will now be described with reference to FIGS. 7 and 9.

FIG. 7 illustrates an example in which a proper amount of oil is stored in the first compressor 11, an insufficient amount of oil is stored in the second compressor 12, and an excessive amount of oil is stored in the third compressor 13.

When the air conditioner begins operation, the compressors 11, 12, and 13 begin to operate (S1). Then, a refrigerant is introduced into the compressors 11, 12, and 13 and compressed. Thereafter, the compressed refrigerant is discharged from the compressors 11, 12, and 13 together with oil.

The bypass valves 81, 82, and 83 can be opened during the operation of the compressors 11, 12, and 13 (S2). Then, a refrigerant or oil is discharged to the bypass pipes 51, 52, and 53.

Referring to FIG. 7, the oil level of the first compressor 11 approximately corresponds to the height at which the first bypass pipe 51 is connected to the compressor 11. Thus, both refrigerant and oil is discharged from the first compressor to the first bypass pipe 51.

The oil level of the second compressor 12 is lower than the height at which the second bypass pipe 52 is connected to the compressor 12. Thus, only refrigerant is discharged from the second compressor 12 to the second bypass pipe 52, as indicated by a dashed line.

The oil level of the third compressor 13 is higher than the height at which the third bypass pipe 53 is connected to the compressor 13. Thus, only oil is discharged from the third compressor 13 to the third bypass pipe 53, as indicated by a solid line.

The fluid discharged to the bypass pipes 51, 52 and 53 is reduced in temperature due to expansion in the pressure reducing parts 54, 55, and 56. Then, the temperature of the fluid is measured by the temperature sensors 84, 85, and 86 (S3).

The control unit 100 compares the temperatures measured by the temperature sensors 84, 85, and 86 with the reference refrigerant temperature T1, the reference oil temperature T2, and the reference temperature T3 stored in the memory unit 110 to determine whether a refrigerant or oil is discharged to the bypass pipes 51, 52 and 53.

In this regard, the control unit 100 may determine whether a refrigerant is discharged to the bypass pipes 51, 52 and 53 (S4), for example, by comparing the temperatures measured by the temperature sensors 84, 85, and 86 with the reference refrigerant temperature T1.

Since the temperatures measured by the temperature sensors 84, 85, and 86 can be varied, as discussed above, a the reference refrigerant temperature T1 can be stored in the memory unit 110 as a range of temperatures. Similarly, the reference oil temperature T2 and the reference temperature T3 can be stored in the memory unit 110 as ranges of temperatures.

When the control unit 100 determines that refrigerant has been discharged to a bypass pipe 51, 52 or 53, the control unit 100 closes the corresponding bypass valves 81, 82, or 83 (S5). Since the compressors 11, 12, and 13 cannot operate efficiently when refrigerant is discharged to the bypass pipes 51, 52 and 53, the bypass valves 81, 82 and 83 are closed to prevent outflow of a refrigerant from the compressors 11, 12 and 13.

In the example shown in FIG. 7, refrigerant may be discharged from the second compressor 12 to the second bypass pipe 52. Thus, in this example, the control unit 100 closes the bypass valve 82.

If it is determined in operation S4 that refrigerant is not discharged to the bypass pipes 51, 52, and 53, it is determined whether oil is discharged to the bypass pipes 51, 52, and 53 (S6). For example, the control unit 100 may compare the temperatures measured by the temperature sensors 84, 85, and 86 with the reference oil temperature T2.

When the control unit 100 determines that oil is discharged to the bypass pipes, the control unit 100 maintains the bypass valves 81, 82, and 83 in an opened state (S7).

In the example shown in FIG. 7, oil is discharged from the third compressor 13 to the third bypass pipe 53. Thus, the bypass valve 83 is kept in an opened state.

Oil discharged to the third bypass pipe 53 flows to the common pipe 50. Then, the oil further flows to the common inlet pipe 30, where the oil is redistributed to the compressors 11, 12, and 13.

While oil is discharged to the third bypass pipe 53, the temperature of the oil is continuously measured by the third temperature sensor 86, and the control unit 100 determines whether the measured temperature reaches the reference temperature T3 (S8).

If the measured temperature reaches the reference temperature T3, the control unit 100 determines that a mixture of refrigerant and oil is discharged to the third bypass pipe 53, and closes the third bypass valve 83 (S9). On the other hand, if the measured temperature does not reach the reference temperature T3, the third bypass valve 83 is kept in the opened state.

If it is determined in operation S6 that the temperatures measured by the temperature sensors 84, 85, and 86 do not correspond to the reference oil temperature T2, the bypass valves 81, 82, and 83 are closed (S10). In the example shown in FIG. 7, a mixture of refrigerant and oil is discharged to the first bypass pipe 51. Thus, the control unit 100 closes the first bypass valve 81. Here, a temperature measured by the first temperature sensor 84 may correspond to the reference temperature T3. In this case, a proper amount of oil may be stored in the first compressor 11, and thus the first bypass valve 81 may be closed to prevent the oil stored in the first compressor 11 from being discharged to the first bypass pipe 51.

According to the current embodiment, when a refrigerant is discharged from one or more of the compressors 11, 12, and 13 to a corresponding bypass pipe 51, 52, or 53, the corresponding bypass valves 81, 82, or 83 are closed. Therefore, an unnecessary discharge and redistribution of a refrigerant from the compressors 11, 12, and 13 can be prevented.

Figure 10:
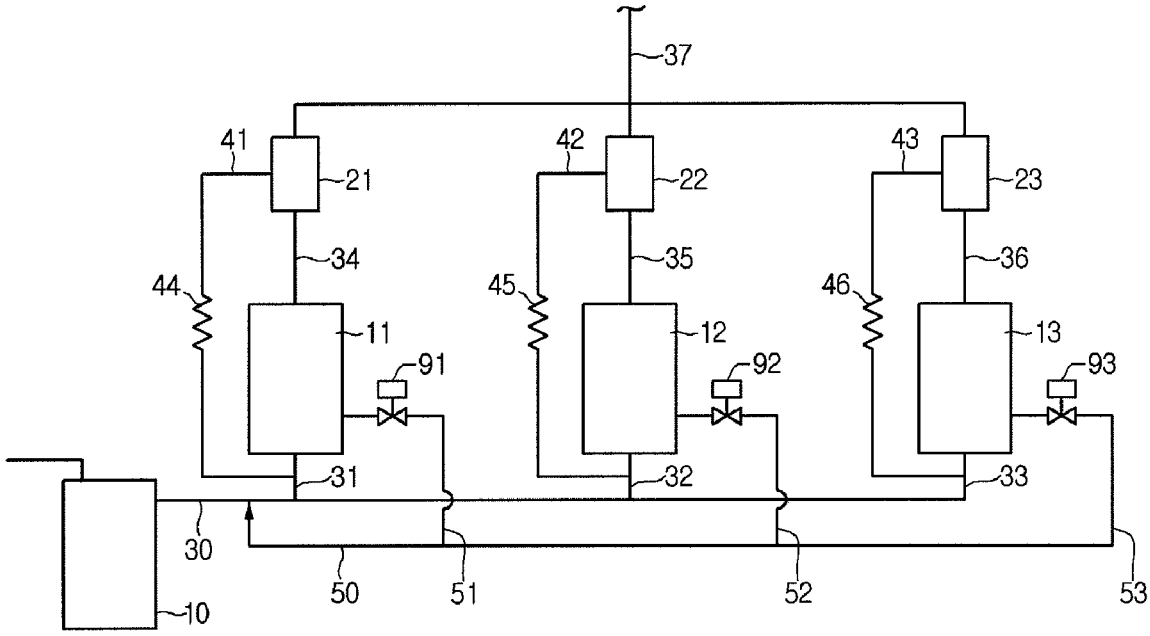
FIG. 10 is a diagram of an air conditioner according to a sixth embodiment of the invention.

FIG. 10 is a diagram of an air conditioner according to a sixth embodiment of the invention.

The air conditioner of the sixth embodiment has the same structure as the air conditioner of the first embodiment except for the structure of pressure reducing parts. In the following description of the sixth embodiment, only the differences between the embodiments are explained.

Referring to FIG. 10, bypass pipes 51, 52, and 53 are connected from compressors 11, 12, and 13 to a common bypass pipe 50. Bypass valves 91, 92, and 93 are disposed at the bypass pipes 51, 52, and 53 for selectively allowing flows of fluid from the compressors 11, 12, and 13 to the bypass pipes 51, 52, and 53 and reducing the pressure of the fluid flowing in the bypass pipes 51, 52, and 53.

The bypass valves 91, 92, and 93 are designed to change flow passage areas of the bypass pipes 51, 52, and 53, respectively. For example, the bypass valves 91, 92, and 93 may be electric expansion valves.

When the bypass valves 91, 92, and 93 are opened, fluid can flow from the compressors 11, 12, and 13 to the bypass pipes 51, 52, and 53. At this time, the flow passage areas of the bypass pipes 51, 52, and 53 can be adjusted using the bypass valves 91, 92, and 93 to reduce the pressure of the fluid flowing in the bypass pipes 51, 52, and 53.

In this way, the bypass valves 91, 92, and 93 can function as pressure reducing parts for reducing the pressure of fluid flowing in the bypass pipes 51, 52, and 53.

According to the current embodiment, an additional structure is not necessary for reducing the pressure of fluid flowing in the bypass pipes 51, 52, and 53, which allows the air conditioner to have a simple structure.

Although the bypass valves 91, 92, and 93 functioning as pressure reducing parts are disposed at the bypass pipes 51, 52, and 53 in the current embodiment, the bypass valves 91, 92, and 93 can be disposed at the common pipe 50.

The embodiments of the air conditioner described above are capable of balancing and maintaining the oil levels of a plurality of compressors of the air conditioner. Thus, a sufficient oil level may be maintained in each of the compressors, minimizing damage to the compressors resulting from an insufficient oil amount.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. An air conditioner comprising:

a plurality of compressors;

a common inlet pipe through which fluid flows to the compressors;

a plurality of inlet pipes branching off from the common inlet pipe which are connected to the compressors;

a plurality of outlet pipes connected to the compressors through which refrigerant discharged from the compressors passes;

a plurality of bypass pipes connected to the compressors through which fluid discharged from the compressors passes; and an accumulator which receives refrigerant from an evaporator, and separates gas and liquid portions of the received refrigerant, wherein the fluid which passes through the plurality bypass pipes moves to the common inlet pipe through the accumulator, and wherein the fluid which passes through the plurality of bypass pipes is distributed to the plurality of compressors through the common inlet pipe.

2. The air conditioner according to claim 1, further comprising a common bypass pipe which is connected to the common inlet pipe, wherein the fluid which passes through the plurality of bypass pipes flows into the common bypass pipe.

3. The air conditioner according to claim 1, wherein the plurality of bypass pipes are connected to the common inlet pipe.

4. The air conditioner according to claim 1, wherein at least one of the bypass pipes comprises a pressure reducing part which reduces a pressure of fluid flowing in the respective bypass pipe.

5. The air conditioner according to claim 4, wherein at least one of the pressure reducing parts comprises a valve which changes a flow passage area of a respective bypass pipe.

6. The air conditioner according to claim 4, wherein at least one of the pressure reducing parts comprises a capillary.

7. The air conditioner according to claim 6, further comprising at least one bypass valve that opens and closes at least one of the bypass pipes.

8. The air conditioner according to claim 7, wherein at least one of the bypass pipes comprises a temperature sensor that measures a temperature of fluid in the respective bypass pipe.

9. The air conditioner according to claim 8, further comprising a memory unit that stores a plurality of reference temperatures.

10. The air conditioner according to claim 9, further comprising a control unit that compares the temperature measured by the temperature sensor with the plurality of referenced temperatures, and controls the bypass valve based on the comparisons.

11. The air conditioner according to claim 9, wherein the plurality of reference temperatures correspond to a temperature of outdoor air.

12. An air conditioner comprising:

a plurality of compressors;

a common inlet pipe through which fluid flows to the compressors;

a plurality of inlet pipes branching off from the common inlet pipe which are connected to the compressors;

a bypass unit that guides fluid discharged from the compressors to the common inlet pipe;

a pressure reducing part that reduces a pressure of fluid flowing in the bypass unit; and an accumulator which receives refrigerant from an evaporator, and separates gas and liquid portions of the received refrigerant, wherein the fluid which passes through the bypass unit moves to the common inlet pipe through the accumulator.

13. The air conditioner according to claim 12, wherein the bypass unit comprises a plurality of bypass pipes connected between the compressors and the common inlet pipe, and the bypass pipes comprise pressure reducing parts.

14. The air conditioner according to claim 12, wherein the bypass unit comprises:

a plurality of bypass pipes connected to the compressors; and a common bypass pipe connected between the bypass pipes and the common inlet pipe, wherein the pressure reducing part is disposed at the common bypass pipe or at each of the bypass pipes.

15. The air conditioner according to claim 12, wherein the bypass unit comprises:

a plurality of bypass pipes connected to the compressors; and a common bypass pipe connected between the bypass pipes and an accumulator.

16. The air conditioner according to claim 12, wherein the pressure reducing part is a capillary.

17. The air conditioner according to claim 16, further comprising a bypass valve that selectively allows fluid to flow in the bypass unit, the bypass valve being periodically opened.

18. The air conditioner according to claim 12, wherein the pressure reducing part is a valve capable of adjusting a size of a flow passage, and the size of the flow passage is periodically adjusted.

19. The air conditioner according to claim 12, wherein the bypass unit comprises a temperature sensor that measures a temperature of fluid passing through the pressure reducing part, and an amount of fluid flowing in the bypass unit is adjusted based on the measured temperature.

20. An air conditioner comprising:

a plurality of compressors;

a common inlet pipe through which fluid flows to the compressor;

a plurality of bypass pipes connected to the compressors to form bypass passages that allow fluid in the compressors to be redistributed among the compressors through the common inlet pipe; and an accumulator which receives refrigerant from an evaporator, and separates gas and liquid portions of the received refrigerant, wherein the fluid which passes through the plurality bypass pipes moves to the common inlet pipe through the accumulator; and a plurality of temperature sensors disposed at the bypass pipes that measure temperatures of fluid flowing in the bypass pipes, wherein amounts of fluid flowing in the bypass pipes are adjusted based on the measured temperatures.

21. The air conditioner according to claim 20, wherein the bypass pipes comprise pressure reducing parts, and the temperature sensors measure temperatures of fluid passing through the pressure reducing parts.

22. The air conditioner according to claim 21, wherein when the measured temperatures correspond to a reference refrigerant temperature, streams of fluid to the bypass pipes are interrupted.

23. The air conditioner according to claim 21, wherein when the measured temperatures correspond to a reference oil temperature, streams of fluid to the bypass pipes are allowed.

24. The air conditioner according to claim 23, wherein when the measured temperatures correspond to a reference temperature, streams of fluid to the bypass pipes are interrupted.

* * * * *